US006574989B1

(12) United States Patent
Lampert

(10) Patent No.: US 6,574,989 B1
(45) Date of Patent: Jun. 10, 2003

(54) COUNTERBALANCED JEWELRY RING

(75) Inventor: David Lampert, Chicago, IL (US)

(73) Assignee: Lester Lampert, Inc., Chicago, IL (US)

( * ) Notice: Subject to any disclaimer, the term of this patent is extended or adjusted under 35 U.S.C. 154(b) by 0 days.

(21) Appl. No.: 09/962,413

(22) Filed: Sep. 25, 2001

(51) Int. Cl.[7] ..... A44C 19/00

(52) U.S. Cl. ..... 63/15; 63/15.1; 63/15.4; 63/31

(58) Field of Search ..... 63/15, 15.1, 15.2, 63/15.3, 15.4, 15.7, 31

(56) References Cited

U.S. PATENT DOCUMENTS

| | | | | | |
|---|---|---|---|---|---|
| 922,212 | A | * | 5/1909 | Tropin | 63/31 |
| 2,060,345 | A | * | 11/1936 | Phillips | 63/3 |
| 4,187,697 | A | * | 2/1980 | Castelo | 63/31 |
| 4,294,084 | A | | 10/1981 | Lampert | |
| 5,228,316 | A | * | 7/1993 | Meyrowitz | 63/15.4 |
| 5,873,265 | A | * | 2/1999 | Simonnet | 63/28 |
| 5,950,456 | A | * | 9/1999 | Kirsch, Jr. | 63/31 |
| 6,101,843 | A | * | 8/2000 | Nagano | 63/15.4 |

OTHER PUBLICATIONS

Unidentified, undated catalog page showing Christian Bauer "Moving Line" of jewelry.

Unidentified, undated magazine article by Barbara Moss entitled "Playing With Your Jewelry."

1995–96 Monte–Trevi, Inc. Catalog entitled "View of Excellence VIII", pp. 9–11 showing motion rings and floating rings.

* cited by examiner

*Primary Examiner*—James R. Brittain
*Assistant Examiner*—Andrea Chop
(74) *Attorney, Agent, or Firm*—Michael Best & Friedrich; Larry L. Saret

(57) ABSTRACT

A jewelry ring has an inner band and an outer band rotatable about the inner band. The outer band has diametrically opposed decorative and counterbalance portions, the decorative portion including a decorative feature, such as a gemstone, and the counterbalance portion weighing more than the decorative portion, such that the decorative feature tends to rotate to face up regardless of the orientation of the wearer's hand.

4 Claims, 4 Drawing Sheets

COUNTERBALANCED JEWELRY RING

FIELD OF THE INVENTION

The present invention relates to jewelry having mobile elements and especially to jewelry rings which have a decorative feature mounted on a counterbalanced rotating band.

BACKGROUND OF THE INVENTION

Jewelry rings are often provided with a decorative feature, such as a mounted gemstone or other design element. However, such decorative features are typically static and often cannot be fully appreciated when the ring is being worn, because they are not always presented at an appropriate viewing angle. For example, the portion of the ring containing the decorative feature is often enlarged or includes the significant weight of the setting and gemstone. The unbalanced weight of the decorative portion sometimes causes the ring to rotate under the force of gravity, such that the decorative portion faces an unintended direction. As a result, the decorative feature rotates out of view and the ring may become uncomfortable or otherwise inconvenient to wear.

Thus, it would be desirable to provide a jewelry ring that has mobile elements to enhance visual interest and increase the likelihood that the decorative feature will be presented in an appropriate viewing angle. In addition, there is a need for a ring where the weight of the decorative portion does not create a tendency for the decorative feature to rotate and become obscured or cause inconvenience.

SUMMARY OF THE INVENTION

These needs and other needs are satisfied by the present invention, which comprises a jewelry ring with an inner band and a rotatable outer band. The outer band has a decorative portion and a counterbalance portion weighing more than the decorative portion. At least one bearing is positioned between the inner band and the outer band, such that the outer band is rotatable about the inner band on the bearing. The outer circumference of the inner band is provided with a race shaped to hold the bearing.

The decorative portion of the outer band includes a gemstone that projects through the outer band toward the inner band, which is provided with a groove shaped to slidably receive the gemstone. The counterbalance portion of the outer band includes a boss positioned diametrically opposite the decorative portion. In an alternative embodiment, the decorative portion is composed of a first material and said counterbalance portion is composed of a second material, the second material being denser than the first material. In yet another embodiment, the decorative portion is hollow and the counterbalance portion is solid.

The inner band is formed from a sleeve and a loop that are connected together. The sleeve has a cylinder sized and shaped to fit within the inner circumference of the outer band. The cylinder has a first end with a first circular flange and a second end with a first connecting member. The loop has a second circular flange with a second connecting member adapted to receive the first connecting member to connect the sleeve to the loop, such that said outer band is rotatable on the cylinder between said first and second circular flanges.

In a preferred embodiment, the first connecting member is a ledge formed in the inner circumference of the cylinder and the second connecting member is a collar sized to fit within the ledge. The sleeve and the loop are connected by welding the joint between the ledge and collar. In an alternative embodiment, the first and second connecting members have complementary threaded portions and the sleeve and the loop are connected by screwing together the first and second connecting members.

DETAILED DESCRIPTION OF THE INVENTION

Figure 1:
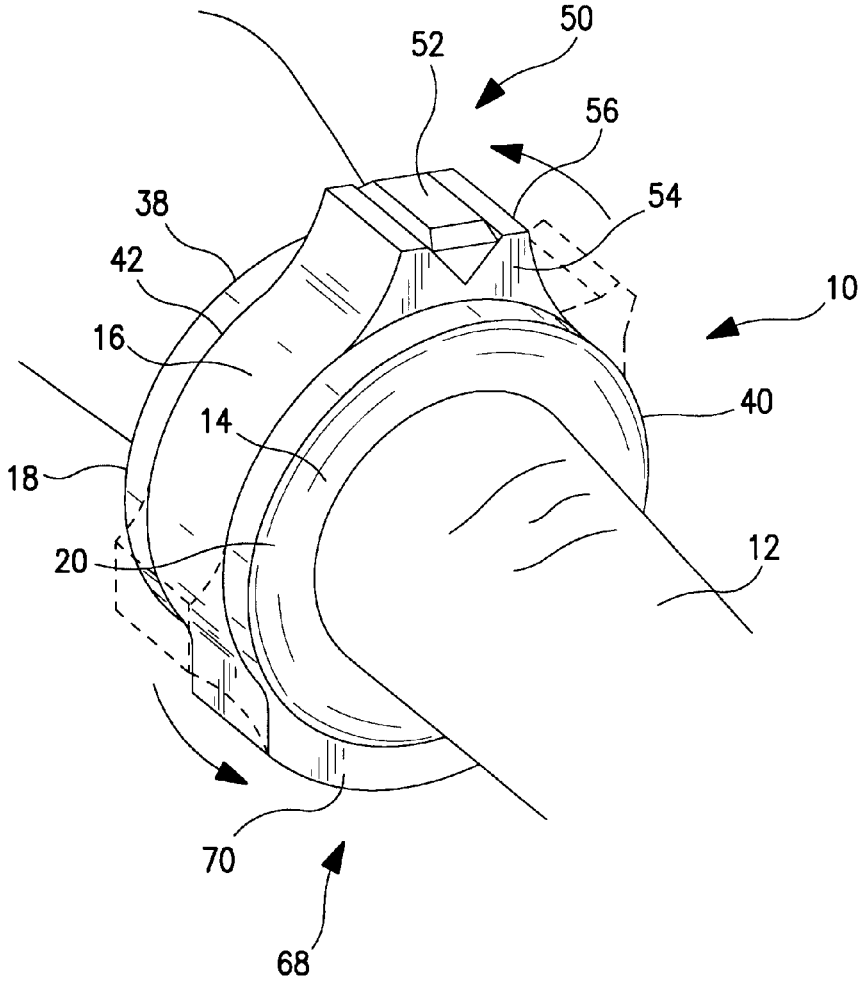
FIG. 1 depicts a perspective view of the jewelry ring of the present invention, as worn on a finger.

In accordance with the present invention, a jewelry ring is described having a decorative feature mounted on a rotatable band such that the decorative feature tends to face up regardless of the orientation of the ring. FIG. 1 shows the jewelry ring 10 of the present invention as worn on a finger 12. Ring 10 is comprised of an inner band 14 and a rotatable outer band 16. Inner band 14 is provided with circular flanges 18, 20 that extend around either side of outer band 16, to retain outer band 16 on inner band 14 and between flanges 18, 20.

Figure 2:
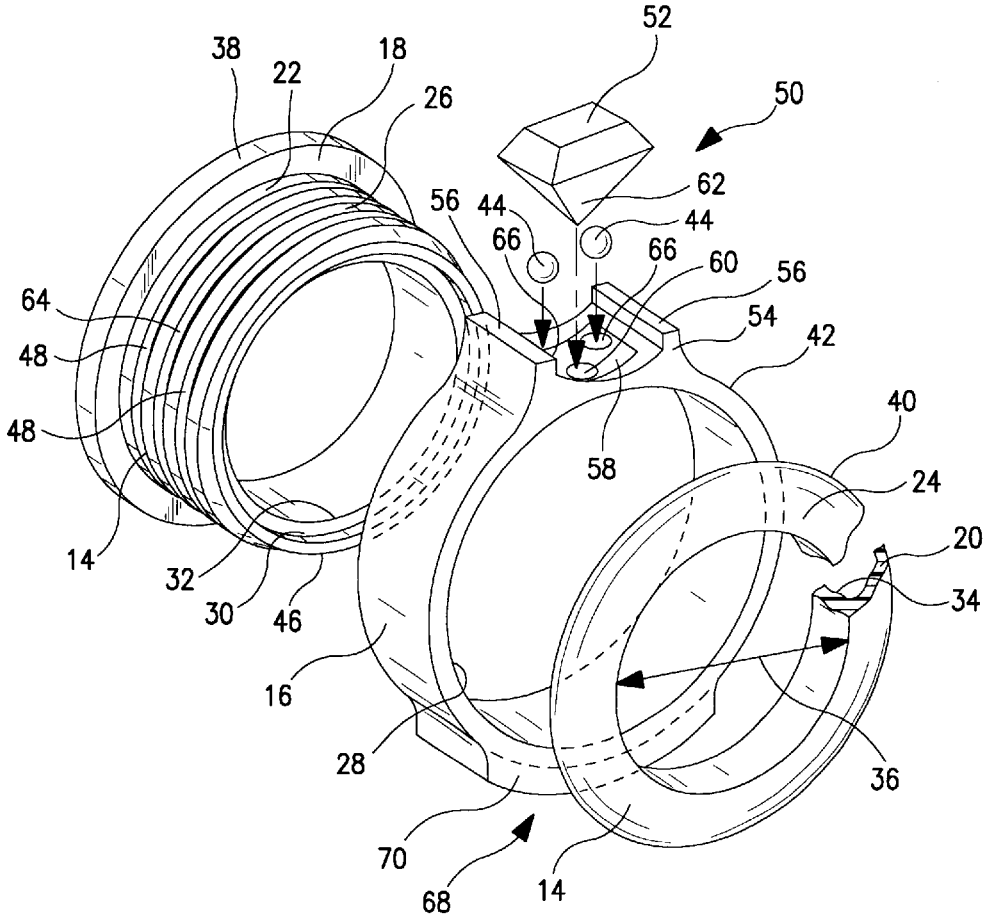
FIG. 2 depicts an exploded perspective view of the jewelry ring of the present invention.

As best shown in FIG. 2, inner band 14 is formed of a sleeve 22 and a loop 24. Sleeve 22 is comprised of a cylinder 26, with a circular flange 18. Cylinder 26 is sized to fit within the inner circumference 28 of outer band 16, such that outer band 16 may rotate freely about inner band 14. A ledge 30 is formed in inner circumference 32 of cylinder 26, opposite circular flange 18. Loop 24 comprises circular flange 20, from which a collar 34 projects inwardly at approximately 90° angle relative to circular flange 20. Collar 34 is sized and shaped to fit within ledge 30 and has the same inner diameter 36 as the inner circumference 32 of cylinder 26.

Figure 4:
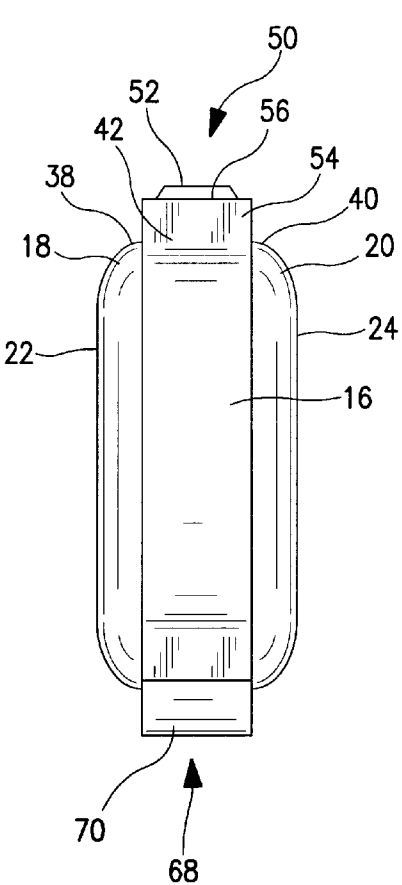
FIG. 4 depicts an side elevation view of the jewelry ring of the present invention.
Figure 3:
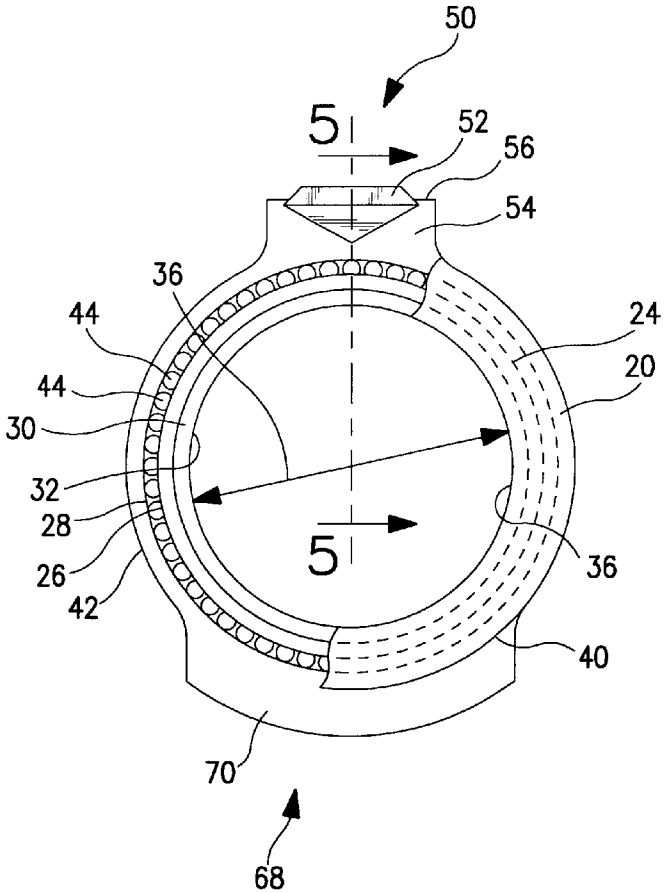
FIG. 3 depicts a front elevation section view of the jewelry ring of the present invention.

Ring 10 is assembled by placing outer band 16 over cylinder 26 of sleeve 22. Loop 24 is then joined to sleeve 22 by seating collar 34 within ledge 30, to form the complete inner band 14 and retain outer band 16 between circular flanges 18, 20. As best shown in FIGS. 3 and 4, it is preferred that circular flanges 18, 20 have at least the same outer diameter 38, 40 as the outer circumference 42 of outer band 16, to provide ring 10 with a smooth and continuous profile.

It is preferred to permanently secure sleeve 22 and loop 24 together by welding the joint between ledge 30 and collar 34 using low melting solder or laser welding, as is well known in the art. The welded seam is then finished to create a smooth, seamless invisible joint that is aesthetically pleasing and comfortable to the wearer. In alternative embodiments, sleeve 22 and loop 24 may be secured by other means well known in the art and which are appropriate for the material of inner band 14. For example, sleeve 22 and loop 24 could be riveted together, or ledge 30 and collar 34 may be threaded to allow sleeve 22 and loop 24 to be screwed together.

In an alternative embodiment, inner band 14 may be formed as a single piece, initially sized to fit within outer band 16, and then enlarged by stretching to retain outer band 16 in place, using a device such as the Kagan Wedding Ringer Sizer sold by Paul H. Gesswein & Co., Inc. (Bridgeport, Conn.). Conversely, outer band 16 may be initially sized to fit over inner band 14, and then shrunk so that inner band 14 could not slide off. In either case, inner or outer bands 14, 16 should not be resized to the extent that it prevents the free rotation of outer band 16 about inner band 14.

Figure 5:
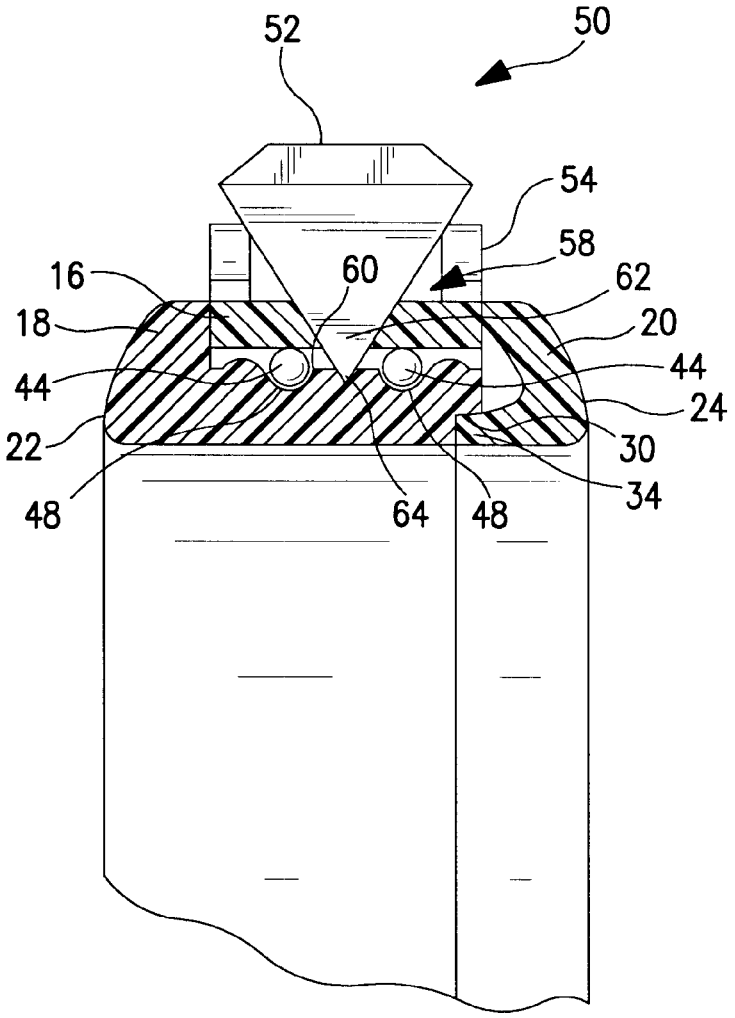
FIG. 5 depicts a partial section view of the jewelry ring of the present invention, showing a gemstone mounted in the outer band.

To facilitate the rotation of outer band 14 about inner band 12, one or more bearings 44 are positioned between the outer circumference 46 of cylinder 26 and the inner circumference 28 of outer band 16. As shown in FIGS. 2 and 5, the outer circumference 46 of cylinder 26 is grooved to form races 48, that are sized and shaped to receive bearings 44 and permit them to rotate freely. In some cases it may be desirable to lubricate the bearings, such as with watchmaker's oil or graphite powder.

It has been determined that 1 mm ceramic ball bearings, such as silicon nitride bearings commercially available from Boca Bearings, Inc. (Boca Raton, Fla.) are suitable for use in the present invention. Ceramic bearings are lighter in weight than comparable metal bearings, reduce the need for lubrication and avoid the possibility of undesirable interactions caused by contact between the dissimilar metals of the bearing and the ring, such as galvanic corrosion. It will be readily apparent to those skilled in the art, that the size and number of the bearings may vary as appropriate for the size and configuration of the ring.

If the outer and inner hands are made sufficiently precisely, no bearings should be necessary and only a lubricant may be needed.

Outer band 16 is provided with a decorative portion 50, including a decorative feature such as a gemstone 52 in a setting 54. As shown in FIG. 2, setting 54 is a channel-type setting that is well known in the art and comprises opposed flanges 56 that are formed integrally with outer band 16, and which define a pocket 58 for receiving gemstone 52. As best shown in FIGS. 2 and 5, pocket 58 is provided with a central opening 60 to permit the point 62 of gemstone 52 to project through outer band 16, and allow gemstone 52 to have a lower profile relative to outer band 16. The outer circumference 46 of cylinder 26 is provided with a groove 64, sized and shaped to slidably receive point 62 of gemstone 52.

Pocket 58 is further provided with temporary openings 66 positioned above races 48 and sized and shaped to receive bearings 44. Once inner and outer bands 14, 16 are assembled, bearings 44 may be fed into races 48 through temporary openings 66. Metal plugs (not shown) are then inserted into openings 66 to fill them and permanently retain bearings 44 within ring 10. The metal plugs are subsequently concealed when gemstone 52 is mounted in setting 54.

In alternative embodiments, setting 54 may have the configuration of any number of settings that are well known in the art (such as a prong, bezel or pave setting), and as dictated by the size, shape and type of gemstone. Moreover, decorative portion 50 may include any of the numerous ornamental features that are well known in the art, some of which may not require a setting, such as a signet formed integrally with outer band 16 or other engraving.

Outer band 16 (FIGS. 2 and 4) is further provided with a counterbalance portion 68 positioned diametrically opposite decorative portion 50. Counterbalance portion 68 operates to change the distribution of weight in ring 10, and counteract the tendency of ring 10 to rotate under the force of gravity such that decorative portion 50 rotates to an undesirable position and faces downward (i.e. visible with the wearer's palm). As best shown in FIGS. 2–4, counterbalance portion 68 comprises a boss 70 that is integrally formed in outer band 16 and sized such that counterbalance portion 68 weighs more than decorative portion 50. Consequently, as the wearer moves his/her hand, the counterbalance portion 68 causes the outer band 16 to rotate under the force of gravity relative to inner band 14, so that decorative portion 50 will always face upward.

In some cases, it may be desirable for ring 10 to have a smooth, continuous profile that is not interrupted by boss 70. Thus, in an alternative embodiment, the relative weight of counterbalance portion 68 may be increased without changing the profile of outer band 16, by forming counterbalance portion 68 of a material having a greater density than the material used to form decorative portion 50. For example, counterbalance portion 68 may be formed of platinum, whereas decorative portion 50 may be formed of a less dense material, such as 14k white gold. It will be apparent to those skilled in that art that other combinations of metals, where the counterbalance weighs more than the decorative portion, are also possible.

In yet another embodiment, decorative portion 50 may be formed of less material than counterbalance portion 68. For example, the structure of counterbalance portion 68 may be solid, whereas the structure of decorative portion 50 may be hollow.

In a preferred embodiment, counterbalance portion 68 is sized to weigh sufficiently more than decorative portion 50, such that when the wearer's hand moves, the difference in weight between counterbalance portion 68 and decorative portion 50 imparts a tendency for outer band 16 to rotate relative to inner band 14, causing the heavier counterbalance portion 68 to rotate and face down, and decorative portion 50 to correspondingly rotate and face up. As a result, decorative portion 50 tends to always face up in the desired orientation, despite changes in the orientation of ring 10 caused by various movements of the wearer's hand.

It is preferred to construct ring 10 of precious metals, such as gold, silver, platinum and/or combinations of such metals. In addition, ring 10 may be constructed of any number of materials that are well known in the art, such as crystal, ivory, stone, gemstones, wood, plastic, and/or combinations of such materials. However, it is presently preferred to avoid using materials that must be plated as a final finishing step, such as 14k white gold plated with rhodium. In such cases, the plating process may interfere with the operation of the bearings.

It will be apparent to those skilled in the art that changes and modifications may be made in the embodiments illustrated herein, without departing from the spirit and the scope of the invention. Thus, the invention is not to be limited to the particular forms herein shown and described except insofar as indicated by the scope of the appended claims.

What is claimed is:

1. A jewelry ring, comprising:

inner and outer bands;

at least one bearing, said inner band having a race shaped to hold said at least one bearing and said outer band rotatable about said inner band on said at least one bearing;

a decorative portion on said outer band wherein said decorative portion includes a gemstone; and a counterbalance portion on said outer band, said counterbalance portion weighing more than said decorative portion.

2. The jewelry ring of claim 1, wherein said outer band includes at least one bearing aperture for loading said at least one bearing into said race.

3. The jewelry ring of claim 2 wherein said at least one bearing aperture is positioned in said decorative portion.

4. A jewelry ring, comprising:

inner and outer bands;

at least one bearing, said inner band having a race shaped to hold said at least one bearing and said outer band rotatable about said inner band on said at least one bearing;

a decorative portion on said outer band wherein said decorative portion includes a gemstone;

wherein said gemstone projects through said outer band toward said inner band, and said inner band has a groove shaped to slidably receive said gemstone; and a counterbalance portion on said outer band, said counterbalance portion weighing more than said decorative portion.

* * * * *